US006966802B2

(12) United States Patent
Hielscher et al.

(10) Patent No.: US 6,966,802 B2
(45) Date of Patent: Nov. 22, 2005

(54) PLUG CONNECTOR

(75) Inventors: Brigitte Hielscher, Frankfurt a.M. (DE); Rolf Jetter, Darmstadt (DE); Alexander Schmid, Alsbach-Haehnlein (DE)

(73) Assignee: Tyco Electroncis AMP GmbH, Bensheim (DE)

( * ) Notice: Subject to any disclaimer, the term of this patent is extended or adjusted under 35 U.S.C. 154(b) by 0 days.

(21) Appl. No.: 10/775,635

(22) Filed: Feb. 10, 2004

(65) Prior Publication Data

US 2004/0224572 A1 Nov. 11, 2004

(30) Foreign Application Priority Data

Feb. 11, 2003 (EP) ..... 03002660

(51) Int. Cl.[7] ..... H01R 13/33
(52) U.S. Cl. ..... 439/841; 439/840; 439/843
(58) Field of Search ..... 439/840, 841, 439/843, 844, 788, 851

(56) References Cited

U.S. PATENT DOCUMENTS 3,470,527 A * 9/1969 Bonhomme ..... 439/843
4,112,953 A 9/1978 Shanker et al.
4,462,657 A * 7/1984 Snowdon et al. ..... 439/840
4,655,462 A 4/1987 Balsells
4,810,213 A 3/1989 Chabot
5,139,276 A 8/1992 Balsells
5,468,153 A 11/1995 Brown et al.
2002/0022411 A1 2/2002 LaCoy

FOREIGN PATENT DOCUMENTS

DE 197 18 448 A1 11/1988
GB 1542602 A 3/1979

* cited by examiner

*Primary Examiner*—Ross Gushi
(74) *Attorney, Agent, or Firm*—Barley Snyder LLC

(57) ABSTRACT

The invention is embodied in a plug connector having first and second plug contacts, a conductive connecting member and a receiving element. The conductive connecting member is formed as a spring and is positioned between the first and second plug contacts to form an electrical contact between an inner surface of the first plug contact and an outer surface of the second plug contact. The receiving element houses the connecting member between the first and second plug contacts.

21 Claims, 4 Drawing Sheets

PLUG CONNECTOR

FIELD OF THE INVENTION

The invention relates to an electrical connector and more particularly a plug connector having a plug contact and a connecting member.

BACKGROUND OF THE INVENTION

Generic plug connectors are known which comprise a male and a female plug contact. For example DE 197 18 448 teaches a female plug contact having grooves on an inner surface into which at least one annular spring is inserted. When assembled, the male plug adjoins the inner region of the annular spring and is electrically connected via the annular spring to the female plug contact. In such plug connectors assembly of the annular spring is very complex.

According to DE 197 18 448 it is also known to assemble the annular spring on a carrier. The carrier contacts the female plug contact via a further annular spring.

A corresponding helical spring is also shown in DE 35 39 608.

It is desirable to improve a plug connector of this type such that conductive connecting member can be positioned on a plug contact in the simplest manner possible.

SUMMARY OF THE INVENTION

The invention is embodied in a plug connector having first and second plug contacts, a conductive connecting member and a receiving element. The conductive connecting member is formed as a spring and is positioned between the first and second plug contacts to form an electrical contact between an inner surface of the first plug contact and an outer surface of the second plug contact. The receiving element houses the connecting member between the first and second plug contacts.

BRIEF DESCRIPTION OF THE DRAWINGS

Embodiments of the invention are shown in the drawings and will be described hereinafter. In the drawings.

In the following description, the same reference numerals are used for the same parts. Repetitive descriptions for the same parts will be dispensed with and reference will be made in each case to descriptions already made or descriptions to follow.

DETAILED DESCRIPTION OF THE INVENTION

Figure 1:
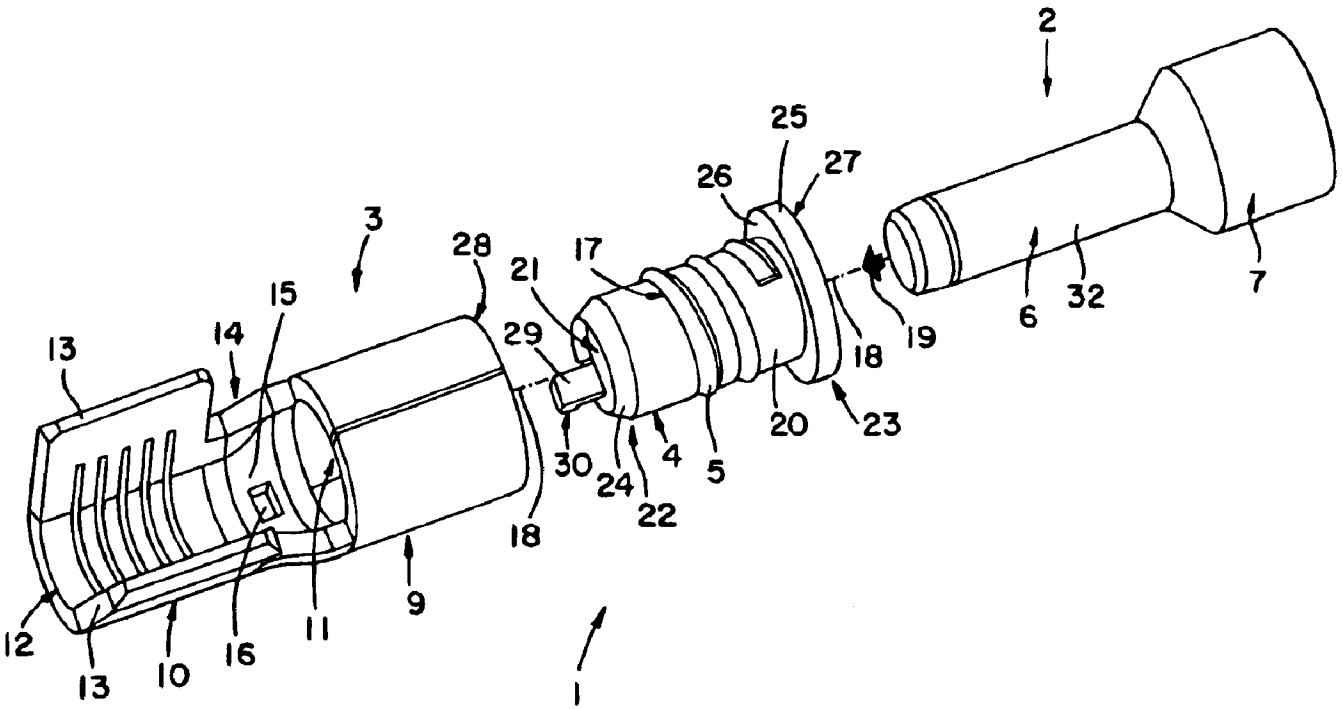
FIG. 1 is a perspective exploded view of a plug connector according to a first embodiment of the invention.

FIG. 1 shows a first embodiment of a plug connector 1 according to the invention. The plug connector 1 consists of a first, male plug contact 2, a second, female plug contact 3 and a receiving element 4. A spring, which may be helical or shaped as a flat spiral spring, forms the connecting member 5, which is captive in the receiving element 4.

The first, male plug contact 2 includes a conductive pin 6 having a cylindrical outer surface 32 and an insulating portion 7.

The second, female plug contact 3 has a conductive receptacle 9 and a crimp section 10. The receptacle 9 is designed as a hollow cylinder. The receiving element 4 and connecting member 5 can be introduced into an inner region 11 of the receptacle 9. The crimp section 10 comprises a rounded region 12 and two wings 13. An insulated conductor of a cable can be inserted in the rounded region 12. The wings 13 can crimped toward the insulated conductor (not shown) to secure it against the rounded region 12. A transition region 14 is formed between the receptacle 9 and the crimp section 10 and has a recess 16 in a base 15.

The receiving element 4 is substantially cylindrical. The connecting member 5 is received in a helical groove 17 of the receiving element 4 so as to be biased. The helical axis 18 of the helical groove 17 runs parallel to a connecting direction 19 of the plug connector 1. The helical axis of the connecting member 5 runs substantially parallel to the connecting direction 19. The connecting member 5 projects slightly beyond an outer cylindrical peripheral region 20 of the receiving element 4. The connecting member 5 projects slightly into a cylindrical hollow inner region 21 of the receiving element 4 as well. The pin 6 can be introduced into the inner region 21 of the receiving element 4. The internal diameter of the connecting member 5 is somewhat smaller than the diameter of the pin 6. The receiving element 4 can, in turn, be introduced into the inner region 11 of the receptacle 9. The external diameter of the connecting member 5 is somewhat larger than the diameter of the inner region 11 of the receptacle 9.

The receiving element 4 is designed, with an outer chamfer 24, so as to be tapered at a first end 22. During introduction into the receptacle 9 of the second, female plug contact 3, the receiving element 4 can be threaded more easily with the aid of the outer chamfer 24.

At a second end 23 the receiving element 4 has a flange 25 projecting transversely to the connecting direction 19. The flange 25 comprises a small bearing face 26 toward the first end 22. On the opposing side, the flange 25 comprises a large bearing face 27. When the receiving element 4 is introduced into the receptacle 9, the small bearing face 26 rests on an end face 28 of the second, female plug contact 3.

At its first end 22 the receiving element 4 comprises a latching element 29. A latching projection 30 is provided on the latching element 29, corresponding to the recess 16 of the second, female plug contact 3. When the receiving element 4 is introduced into the receptacle, the latching projection 30 engages in the recess 16.

Figure 2:
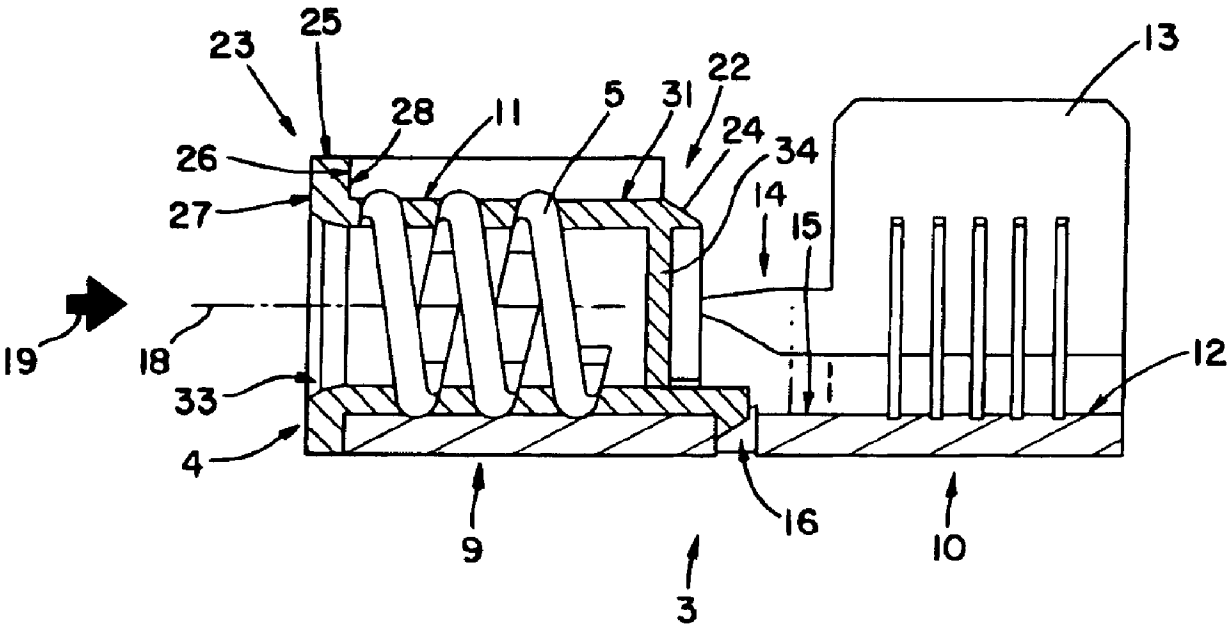
FIG. 2 is a sectional view of a pre-assembled part of the plug connector according to the first embodiment of the invention.

FIG. 2 shows, in a sectional view, a partially pre-assembled state of the plug connector 1. Here the receiving element 4 receiving the connecting member 5 is introduced into the inner region 11 of the receptacle 9. The receiving element 4 is located here in an inserted position in which it is urged into the female plug contact 3 in the connecting direction 19. In this inserted position the latching element 29 of the receiving element 4 is latched with the second, female plug contact 3 by the latching projection 30 engaging the recess 16. The small bearing face 26 of the receiving element 4 rests on the end face 28 of the second, female plug contact 3. The receiving element 4 is therefore secured against further movement in the connecting direction 19. The connecting member 5 is biased toward an inner surface 31 of the receptacle 9 within the inner region 11 such that the connecting member 5 is electrically connected to the second female plug contact 3.

The inner region 21 of the receiving element 4 has an inner chamfer 33 proximate the second end 23. The inner chamfer 33 allows the male plug contact 2 to be introduced more easily into the inner region 21 of the receiving element 4.

The male plug contact 2 is introduced into the inner region 21 of the receiving element 4 from the second end 23. The inner region 21 is closed by a wall 34 near the end face opposite the first end 22. The second plug contact 3 and receiving element 4 assembly can be sheathed with material such that the inner region 21 is sealed against penetration by contaminants from the sides of the second plug contact 3.

In a further embodiment of the invention at least one closed annular flat spiral spring can be provided instead of the open helical flat spiral spring. The helical axis of the spring then runs substantially transversely to the connecting direction 19 of the plug contacts 2, 3.

Figure 3:
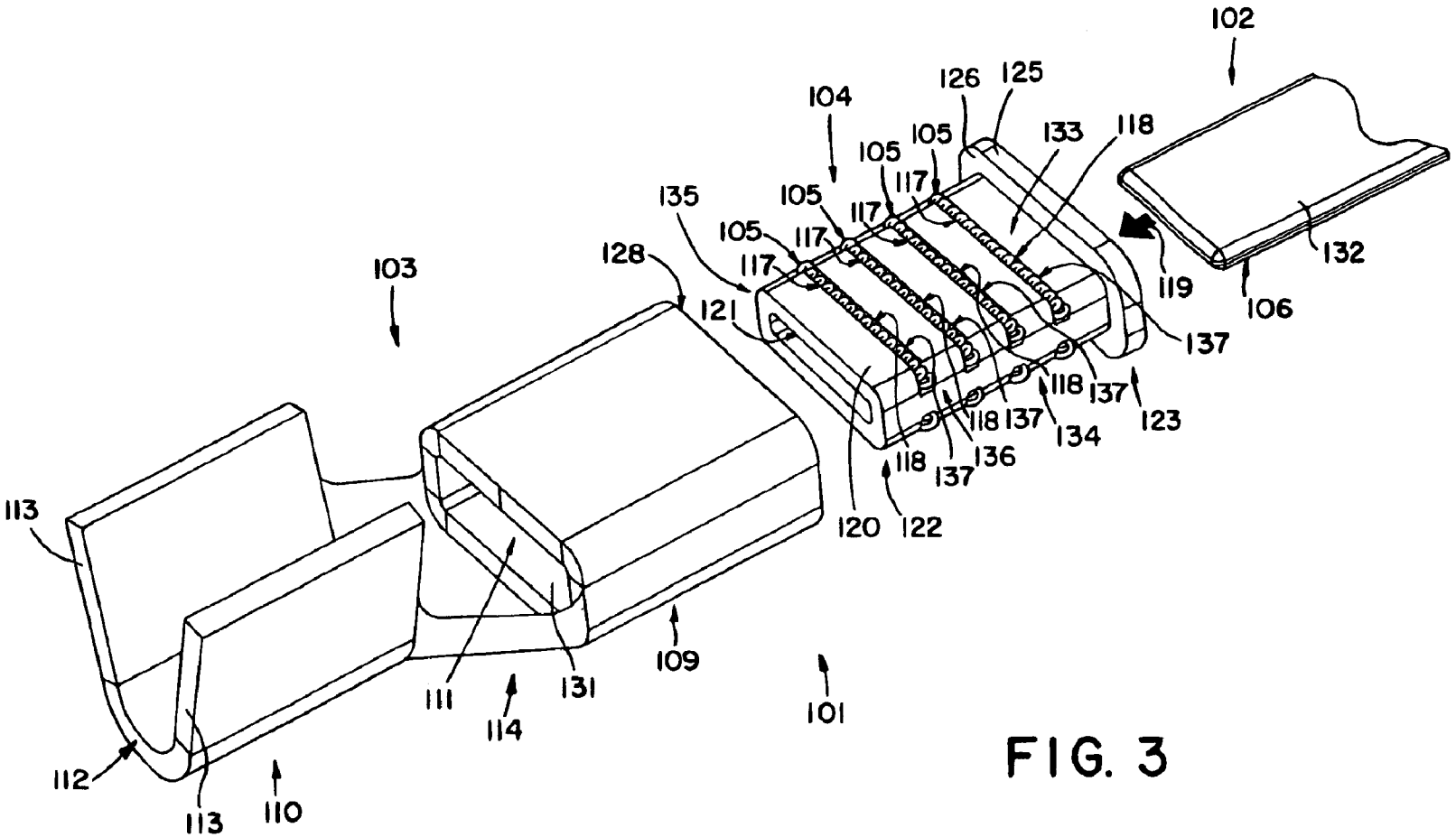
FIG. 3 is a perspective exploded view of a plug connector according to a second embodiment of the invention.

FIG. 3 shows, in a perspective exploded view, a second embodiment of the invention. A plug connector 101 comprises a first, male plug contact 102, a second, female plug contact 103 and a receiving element 104. The receiving element 104 receives four respective connecting members 105 formed as annular flat spiral springs.

The first, male plug contact 102 comprises a pin 106. The pin 106 consists of a conductive flat material and has an outer surface 132.

The second, female plug contact 103 consists of a conductive material and comprises a receptacle 109 and a crimp section 110. The receptacle 109 is substantially rectangular in cross section and has an inner region 111. The receiving element 104 with received connecting members 105 can be introduced into the inner region 111. The second, female plug contact 103 has an inner surface 131 in the inner region 111.

The crimp section 110 is similar to the crimp section 10 of the first embodiment of the invention. Accordingly, the crimp section 110 of the second embodiment of the invention has a rounded region 112 and wings 113.

Also similarly identical to the first embodiment of the invention, the transition region 114 forms a transition between the receptacle 109 and the crimp section 110 of the second, female plug contact 103.

The receiving element 104 is substantially rectangular in cross section and also has an inner region 121. The pin 106 can be received in the inner region 121.

The receiving element 104 has four transverse grooves 117 into which the connecting members 105 are each received so as to be biased. The transverse grooves 117 are annular grooves and are substantially designed so as to penetrate the receiving element 104 in the region of a first side 133 and a second side 134 which oppose one another. An outer peripheral region 120 of the receiving element 104 is designed so as to be continuous in the region of a third and fourth sides 135, 136.

The connecting members 105 each project slightly beyond the outer peripheral region 120 of the receiving element 104 in the region of the first and second sides 133, 134. In this region of the transverse grooves 117, the connecting members also project slightly into the inner region 121 of the receiving element 104.

The connecting members 105 are each formed from flat spiral springs, of which the helical axes 118 each run substantially transversely to a connecting direction 119 of the plug connector 101. The helical axes 118 each run within the helical body 137 of the annular springs 105.

The receiving element 104 has a first end 122 and a second end 123. Like the first embodiment of the invention the receiving element 104 has a flange 125 at the second end. A small bearing face 126 of the flange 125 rests on an end face 128 of the receptacle 109 when the receiving element 104 is introduced in the receptacle 109 of the second, female plug contact 103. The connecting members 105 therefore make electrical contact with the inner surface 131 of the receptacle 109.

Figure 4:
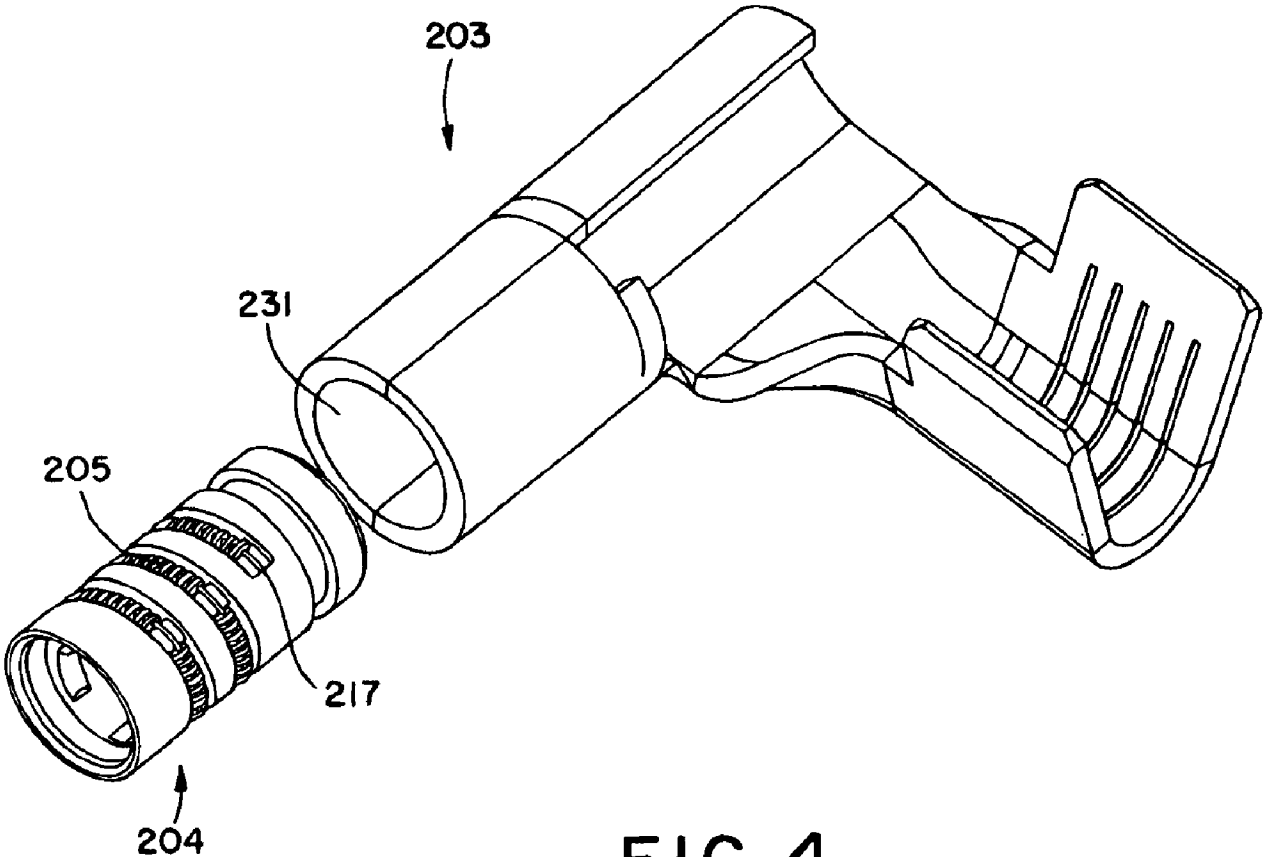
FIG. 4 is an exploded view of a female plug contact of a third embodiment.

A third embodiment provides a design very similar to that in FIG. 1. FIG. 4 shows an exploded view of a female plug contact 203 according to the third embodiment. The connecting member 205 comprises flat spiral spring regions and straight regions one after the other. It is arranged in a groove 217 of a receiving element 204. At the straight regions the connecting member 205 is fixed on the receiving element 204. If the receiving element 204 is an injection moulded part this can, for example, take place by sheathing the straight regions of the spring.

Operation of the embodiments shown in the drawings will be described hereinafter.

During assembly of the first embodiment of the invention connecting member 5 is firstly inserted into the helical groove 17 of the receiving element 4. The receiving element 4 with the connecting member 5 is then introduced in the connecting direction 19 into the receptacle 9 of the second, female plug contact 3.

The inner surface 31 of the receptacle 9 is inserted into the connecting member 5 such that the insertion force gradually increases with further insertion. Once the receiving element 4 reaches the end position the small bearing face 26 of the flange 25 and the end face 28 of the receptacle 9 rest on one another. The latching projection 30 of the latching element 29 also engages in the recess 16 of the transition region 14.

During introduction of the receiving element 4 into the receptacle 9 the connecting member 5 is slightly compressed, so it accordingly presses against the inner surface 31 of the receptacle 9.

If the receiving element 4 is introduced into the receptacle 9, the pin 6 of the first, male plug contact 2 may be introduced into the inner region 21 of the receiving element 4. In the process, the outer surface 32 of the pin increasingly comes into contact with the connecting member 5, as a function of the insertion depth attained. The insertion force increases gradually during insertion.

Prior to insertion of the pin 6 into the receiving element 4, material, for example a plastic material, can optionally be applied (injection-moulded) onto the unit made of receiving element 4 and female plug contact 3. For this purpose, firstly a conductor is crimped to the female plug contact 3 in the crimp section 10. The inner region 21 of the receiving element 4 is closed by a device or a tool which is applied to the large bearing face 27 of the flange 25. Injection moulding is applied such that the inner region 21 of the receiving element 4 is protected against penetration by contaminants. After gating, the pin 6 is introduced into the inner region 21 of the receiving element 4.

By resting on the inner surface 31 of the female plug contact 3 and by resting on the outer surface 32 of the male plug contact 2, in the connected state, the connecting member 5 makes an electrical connection between these plug contacts 2, 3.

The assembly sequence can also optionally be changed such that the pin 6 is firstly inserted into the receiving element 4 and this unit is then introduced into the receptacle 9.

Assembly of the plug connector 101 of the second embodiment of the invention proceeds analogously to assembly of plug connector 1 of the first embodiment of the invention. The annular springs 105 are firstly assembled on the receiving element 104, then the receiving element 104 is introduced into the receptacle 109 of the second, female plug contact 103. The pin 106 of the first, male plug contact 102 is then introduced into the receiving element 104. The assembly sequence can also be changed here such that firstly the pin 106 is inserted into the receiving element 104 and this unit is then introduced into the receptacle 109.

The connecting members 105 consisting of annular flat spiral springs adapt particularly well to the inner surface 131 of the receptacle 109 and to the outer surface 132 of the pin 106. Because of their helical design, the connecting members 105 are in a defined biased state when the plug contacts 102, 103 are connected. A reliable electrical contact between the annular spring 105 and the inner surface 131 of the receptacle 109 and the outer surface 132 of the pin 106 is also ensured.

What is claimed is:

1. A plug connector comprising:

a first plug contact;

a second plug contact;

a conductive connecting member formed as a spring, positioned between the first and second plug contacts and forming an electrical contact between an inner surface of the first plug contact and an outer surface of the second plug contact; and, a receiving element substantially surrounding and housing the conductive connecting member between the first and second plug contacts, wherein the connecting member is a flat sprial spring in certain sections.

2. The plug connector according to claim 1 wherein the receiving element further comprises a latching element having a latching projection which is engagable with a recess located in one of the first and second plug contacts.

3. The plug connector according to claim 1 wherein the connecting member further comprises flak spiral spring regions and straight regions located one after the other.

4. The plug connector according to claim 3 wherein the connecting member is fastened to the receiving element at the straight regions.

5. The plug connector according to claim 4 wherein the receiving element is a plastic injection moulded part to which the connecting member is fastened.

6. A plug connector comprising:

a first plug contact;

a second plug contact;

a conductive connecting member formed as a spring, positioned between the first and second plug contacts and forming an electrical contact between an inner surface of the first plug contact and an outer surface of the second plug contact; and a receiving element substantially surrounding and housing the conductive connecting member between the first and second plug contacts, wherein the connecting member is a flat spiral spring.

7. A plug connector comprising:

a first plug contact;

second plug contact;

a conductive connecting member formed as a spring, positioned between the first and second plug contacts and forming an electrical contact between an inner surface of the first plug contact and an outer surface of the second plug contact; and, a receiving element substantially surrounding and housing the conductive connecting member between the first and second plug contacts, and comprising a helical groove into which the connecting member can be inserted.

8. The plug connector according to claim 7 wherein the connecting member is arranged to be biased within the helical groove.

9. The plug connector according to claim 8 wherein a helical axis of the connecting member runs approximately transverse to a connecting direction of the plug contacts.

10. A plug connector comprising:

a first plug contact;

a second plug contact;

a conductive connecting member formed as a spring, positioned between the first and second plug contacts and forming an electrical contact between an inner surface of the first plug contact and an outer surface of the second plug contact; and, a receiving element substantially surrounding and housing the conductive connecting member between the first and second plug contacts, wherein the connecting member is approximately annular and the receiving element comprises at least one transverse groove into which the connecting member is inserted.

11. An electrical connector arrangement comprising:

a male plug contact having a substantially cylindrical conductive outer surface;

a female plug contact having a substantially cylindrical conductive inner surface;

a conductive connecting member formed as a spring; and, a receiving element housing said conductive connecting member wherein the male plug contact biases the connecting member outwardly and the female plug contact biases the connecting member inwardly to form an electrical connection between the male plug contact and the female plug contact.

12. The electrical connector arrangement according to claim 11 wherein the conductive connecting member is approximately annular and the receiving element comprises at least one transverse groove into which the conductive connecting member is inserted.

13. The electrical connector arrangement according to claim 11 wherein the conductive connecting member is a flat spiral spring.

14. The electrical connector arrangement according to claim 13 wherein the conductive connecting member is fastened to the receiving element at the straight regions.

15. The electrical connector arrangement according to claim 14 wherein the receiving element is a plastic injection moulded part to which the conductive connecting member is fastened.

16. The electrical connector arrangement according to claim 11 wherein the receiving element further comprises a helical groove into which the connecting member can be inserted.

17. The electrical connector arrangement according to claim 16 wherein the conductive connecting member is arranged to be biased within the helical groove.

18. The electrical connector arrangement according to claim 17 wherein a helical axis of the conductive connecting member runs approximately transverse to a connecting direction of the plug contacts.

19. The electrical connector arrangement according to claim 11 wherein the conductive member is a flat spiral spring in certain sections.

20. The electrical connector arrangement according to claim 19 wherein the conductive connecting member further comprises flat spiral spring regions and straight regions located one after the other.

21. The electrical connector arrangement according to claim 19 wherein the receiving element further comprises a latching element having a latching projection which is engagable with a recess located in one of the first and second plug contacts.

* * * * *

UNITED STATES PATENT AND TRADEMARK OFFICE

CERTIFICATE OF CORRECTION

PATENT NO. : 6,966,802 B2
APPLICATION NO. : 10/775635
DATED : November 22, 2005
INVENTOR(S) : Hielscher et al.

It is certified that error appears in the above-identified patent and that said Letters Patent is hereby corrected as shown below:

Column 5,
Line 39, "further comprises flak" should read -- further comprises flat --.

Column 6,
Line 66, "the conductive member" should read -- the conductive connecting member --.

Signed and Sealed this

Twenty-seventh Day of June, 2006

JON W. DUDAS
*Director of the United States Patent and Trademark Office*